US009014379B2

(12) United States Patent
Rank et al.

(10) Patent No.: US 9,014,379 B2
(45) Date of Patent: Apr. 21, 2015

(54) METHOD OF INITIALIZING A BINAURAL HEARING AID SYSTEM AND A HEARING AID

(75) Inventors: Mike Lind Rank, Farum (DK); Preben Kidmose, Maarslet (DK)

(73) Assignee: Widex A/S, Lynge (DK)

( * ) Notice: Subject to any disclaimer, the term of this patent is extended or adjusted under 35 U.S.C. 154(b) by 589 days.

(21) Appl. No.: 13/328,152

(22) Filed: Dec. 16, 2011

(65) Prior Publication Data

US 2012/0148054 A1 Jun. 14, 2012

Related U.S. Application Data

(63) Continuation-in-part of application No. PCT/EP2009/057519, filed on Jun. 17, 2009.

(51) Int. Cl.
*H04R 5/00* (2006.01)
*H04R 25/00* (2006.01)

(52) U.S. Cl.
CPC ..... *H04R 25/552* (2013.01); *H04R 25/30* (2013.01); *H04R 25/505* (2013.01); *H04R 25/70* (2013.01)

(58) Field of Classification Search
CPC ..... H04R 25/552; H04R 25/70; H04R 25/30; H04R 25/505; H04R 25/00
USPC ..... 381/23.1, 60, 312, 314, 315
See application file for complete search history.

(56) References Cited

U.S. PATENT DOCUMENTS

| | | | | |
|---|---|---|---|---|
| 6,549,633 | B1 * | 4/2003 | Westermann | 381/312 |
| 2004/0013280 | A1 | 1/2004 | Niederdrank | |
| 2006/0233385 | A1 * | 10/2006 | Allegro Baumann et al. | 381/60 |
| 2007/0291969 | A1 | 12/2007 | Tateno et al. | |

FOREIGN PATENT DOCUMENTS

| | | | |
|---|---|---|---|
| DE | 102006061176 | A1 | 7/2008 |
| EP | 0941014 | A2 | 9/1999 |
| JP | 2004-535082 | A | 11/2004 |
| JP | 2007-336308 | A | 12/2007 |
| WO | WO 9943185 | A1 | 8/1999 |
| WO | WO 03007655 | A1 | 1/2003 |
| WO | WO 2004110099 | A2 | 12/2004 |
| WO | WO 2006042540 | A1 | 4/2006 |

OTHER PUBLICATIONS

Japanese Office Action for Japanese Application No. 2012-514361 dated Feb. 12, 2013 w.
International Search Report for PCT/EP2009/057519 dated Mar. 12, 2010.

* cited by examiner

*Primary Examiner* — Paul S Kim
(74) *Attorney, Agent, or Firm* — Sughrue Mion, PLLC

(57) ABSTRACT

In a method of initializing a binaural hearing aid system (1) both ipse- and contra-lateral individualized adjustment data are stored in both hearing aids of the binaural hearing aid system for transmission between the hearing aids. This provides an easy backup of the data. The invention further provides a hearing aid having means adapted for performing such a method.

15 Claims, 6 Drawing Sheets

| | | Right Hearing Aid | | |
|---|---|---|---|---|
| | | Ipse-lateral data only | Ipse- and contra-lateral data | No data |
| Left Hearing Aid | Ipse-lateral data only | Exchange ipse-lateral data, then binaural operation | Exchange ipse-lateral data, then binaural operation | Monaural operation on left hearing aid |
| | Ipse- and contra-lateral data | Exchange ipse-lateral data, then binaural operation | Exchange ipse-lateral data, then binaural operation | Transmit ipse- and contra-lateral data, then binaural operation |
| | No data | Monaural operation on right hearing aid | Transmit ipse- and contra-lateral data, then binaural operation | No operation |

*Fig. 9*

METHOD OF INITIALIZING A BINAURAL HEARING AID SYSTEM AND A HEARING AID

RELATED APPLICATIONS

The present application is a continuation-in-part of application PCT/EP2009/057519, filed on Jun. 17, 2009, with the European Patent Office and published as WO 2010/145698.

BACKGROUND OF THE INVENTION

1. Field of the Invention

The present invention relates to hearing aids. The invention, more specifically, relates to a binaural hearing aid system. The invention further relates to a method of initializing a binaural hearing aid system.

In the context of the present disclosure, a hearing aid should be understood as a small, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

A binaural hearing aid system comprises two hearing aids and is for use by a hearing-impaired person who suffers a hearing deficit on both ears. In most cases the hearing deficit is not the same for the two ears.

2. The Prior Art

U.S. Pat. No. 6,549,633 B1 discloses a binaural digital hearing aid system characterized in that the digital signal processing means of each hearing aid unit is arranged to effect a substantially full digital signal processing including individual processing of signals from the input transducer means of the actual unit and simulated processing of signals from the input transducer means of the other unit as well as binaural signal processing of signals supplied, on one hand, internally from the input signal transducer means of the same unit and, on the other hand, via a communication link from the input signal transducer means of the other unit. Hereby each of the hearing aid units, for the left and right side ears respectively, perform in addition to digital signal processing adapted to compensate for the hearing loss of the ear served by the unit, a simulated full digital signal processing of sound signals received by the unit for the opposite ear and adapted to compensate for the specific hearing loss of that ear, as well as a common binaural signal processing taking into account both of the normally different compensation characteristics of both units.

It is well known, for a hearing aid fitter, to program each one among a pair of hearing aids with a set of individualized adjustment data adapted to the specific compensation requirements of the corresponding ear of the intended user. This data set includes e.g. filter coefficients for the filters in the signal processing path. If, in addition to the above, a second set of individualized adjustment data adapted to the specific compensation requirements of the other ear of the intended user is to be programmed into each one among the same pair of hearing aids, then the hearing aid fitting practice would need to be changed because the hearing aid fitter must take care that both sets of individualized adjustment data would be stored in both hearing aids. This would increase the time that the hearing aid fitter needs to spend on each fitting.

Sometimes one of the two hearing aids of a binaural hearing aid system fails and needs repair. In case the hearing impaired user is given a replacement for the failed hearing aid, the replacement hearing aid normally needs to be programmed by a hearing aid fitter in accordance with the specific compensation requirements of the hearing aid user.

It is therefore a feature of the present invention to overcome at least these drawbacks and provide a method for initialization of a binaural hearing aid system, and a hearing aid and a binaural hearing aid system adapted for operating according to such a method.

SUMMARY OF THE INVENTION

The invention, in a first aspect, provides a method for initialization of a first hearing aid and a second hearing aid of a binaural hearing aid system, said method comprising the steps of programming said first hearing aid with a first set of individualized adjustment data adapted to the specific compensation requirements of the first ear of the intended user, programming said second hearing aid with a second set of individualized adjustment data adapted to the specific compensation requirements of the second ear of the intended user, sending the first set of programmed individualized adjustment data from said first hearing aid, for storage in said second hearing aid, and sending the second set of programmed individualized adjustment data from said second hearing aid, for storage in said first hearing aid.

This provides a method that is simple to implement and does not require any modification of normal hearing aid fitting practice with respect to where to store the two sets of individualized adjustment data adapted to the specific compensation requirements of the ears of the intended user.

The invention, in a second aspect, provides a first hearing aid of a binaural hearing aid system comprising transceiver means adapted for providing a bidirectional communication link with a second hearing aid of the binaural hearing aid system, first memory means adapted for storing ipse-lateral individualized adjustment data adapted to the specific compensation requirements of the intended user, second memory means adapted for storing contra-lateral individualized adjustment data adapted to the specific compensation requirements of the intended user, means for determining whether individualized adjustment data are stored in said first hearing aid, means for detecting when a second hearing aid is powered up, means for sending individualized adjustment data, and means for receiving and storing individualized adjustment data.

This provides a hearing aid that is simple to program with two sets of individualized adjustment data and easy to replace in case of failure or malfunction.

The invention, in a third aspect, provides a binaural hearing aid system comprising a first hearing aid, said first hearing aid having first transceiver means; a second hearing aid, said second hearing aid having second transceiver means; said first and said second transceiver means being adapted for providing a bidirectional communication link between said first and said second hearing aid; wherein said first hearing aid has first memory means adapted for storing ipse-lateral individualized adjustment data adapted to the specific compensation requirements of a first ear of the intended user, second memory means adapted for storing contra-lateral individualized adjustment data adapted to the specific compensation requirements of a second ear of the intended user, means for determining whether individualized adjustment data are stored in said first hearing aid, and means for detecting when said second hearing aid is powered up; and wherein said first transceiver means is adapted for transmitting individualized adjustment data, and for receiving and storing individualized adjustment data.

This provides a method that enables one of the two hearing aids in a binaural hearing aid system to be replaced by a new hearing aid without the need for programming of the new hearing aid by a hearing aid fitter. Instead the new hearing aid will be programmed with all necessary data during the initialization phase according to an embodiment of the invention.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings:

FIG. 9 is a table illustrating the nine states of binaural hearing aid system and the respective actions to be taken during the initialization process.

DETAILED DESCRIPTION

In order to more fully detail the present invention some terms used in the definition of the invention are explained in the following.

In the present disclosure the term "individualized adjustment data" represents the data required in a hearing aid for processing an input transducer signal in order to compensate the hearing deficit of the intended user. A hearing aid may hold several sets of individualized adjustment data. As an example a hearing aid with multiple hearing aid programs will typically hold a corresponding number of individualized adjustment data sets. The setting of the hearing aid determines which hearing aid programme is used. It is well known in the art to exchange setting parameters during operation of a binaural hearing aid system.

In the present disclosure the term "valid individualized adjustment data" represents individualized adjustment data that at some point have been stored in a hearing aid. Thus as an example a hearing aid that is received directly from the manufacturer will not hold valid individualized adjustment data. In one embodiment the validity of the data is determined by a flag, that is set when a set of individualized adjustment data are stored in the hearing aid.

Figure 1:
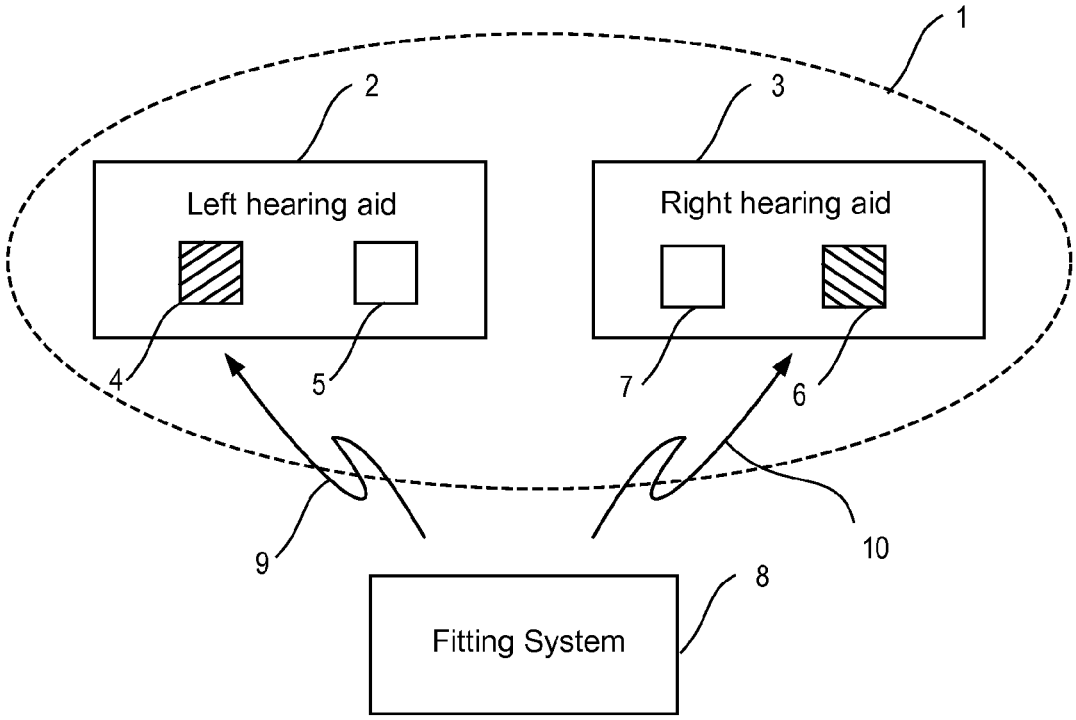
FIG. 1 Illustrates schematically a first step in an initialization process of a binaural hearing aid system, according to an embodiment of the present invention.

Reference is first made to FIG. 1, which illustrates a binaural hearing aid system 1 consisting of a left hearing aid 2 and a right hearing aid 3 and a fitting system 8, which includes a computer and means for wirelessly transmitting data to the hearing aids, according to an embodiment of the invention. The left hearing aid comprises memory means 4 for storage of a first set of individualized adjustment data adapted to the specific compensation requirements of the left ear of the intended user, which may be denoted left ear ipse-lateral data, and memory means 5 for storage of a second set of individualized adjustment data adapted to the specific compensation requirements of the right ear of the intended user, which may be denoted left ear contra-lateral data. In a similar manner the right hearing aid comprises memory means 6 for storage of the second set of individualized adjustment data adapted to the specific compensation requirements of the right ear of the intended user, which may be denoted right ear ipse-lateral data, and memory means 7 for storage of the first set of individualized adjustment data adapted to the specific compensation requirements of the left ear of the intended user, which may be denoted right ear contra-lateral data.

FIG. 1 further illustrates how the first set of individualized adjustment data adapted to the specific compensation requirements of the left ear of the intended user is transmitted wirelessly in data message 9 from the fitting system 8 and to the first hearing aid 2, wherein the adjustment data are received and stored in memory means 4, and how the second set of individualized adjustment data adapted to the specific compensation requirements of the right ear of the intended user is transmitted wirelessly in data message 10 from the fitting system 8 and to the second hearing aid 3, wherein the adjustment data are received and stored in memory means 6.

Generally, the fitting system will comprise means for selectively enabling and disabling exchange of data between the hearing aids. If exchange is enabled, the hearing aids can engage in various procedures of data exchange, as will be described in the following.

Figure 2:
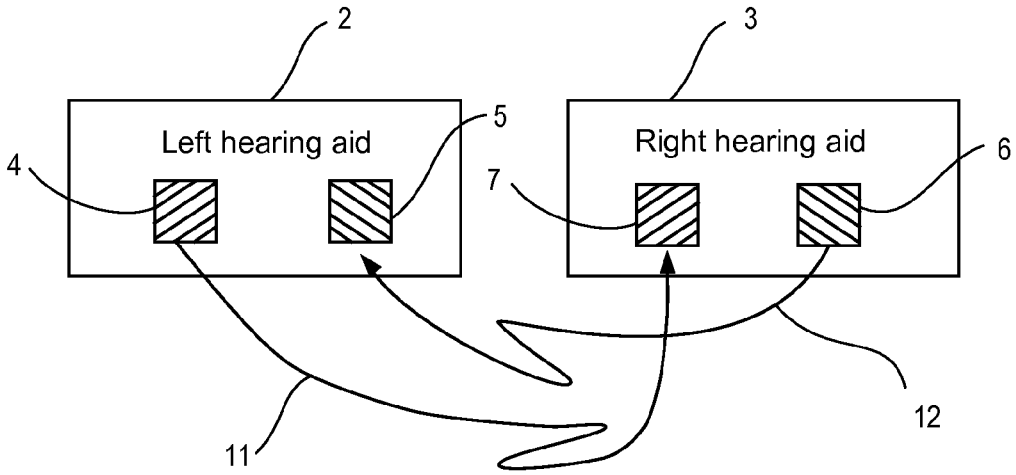
FIG. 2 Illustrates schematically a second step in the initialization process of the binaural hearing aid system of FIG. 1, according to an embodiment of the present invention.

Reference is now made to FIG. 2, which illustrates a procedure, where the first and second set of individualized adjustment data are exchanged wirelessly by data messages 11 and 12 between the two hearing aids. This procedure may be carried out subsequent to the initial fitting as described above with reference to FIG. 1, e.g. at the next power up of the two hearing aids, in order to ensure that both sets of individualized adjustment data are stored in both hearing aids.

The data messages 11 and 12 may, in addition to the individualized adjustment data, comprise corresponding calibration data. In this way each of the hearing aids may contain a set of individualized adjustment data and calibration data for itself and a similar set for the other hearing aid.

Various types of calibration data exist. A first type concerns the specific hearing aid model. One piece of data is the spacing between the microphones in a dual microphone heaing aid. Another piece of data is the acoustic transfer function from free field to microphone input since this depends on the mechanical construction of the hearing aid model. Further data concern the specific components in the hearing aid such as e.g. the microphone response offset per frequency band. Yet another type of calibration data is related to various adaptive hearing aid processes such as e.g. adaptive microphone matching. Adaptive microphone matching is further described in WO-A1-2006042540. This type of calibration data distinguishes some of the other types of calibration data in being dynamic i.e. capable of changing during normal operation. Generally it is favored to exchange dynamic calibration data at hearing aid power up.

As described above various types of calibration data exist. Generally the ipse-lateral calibration data will be stored in the hearing aid as part of the manufacturing process, and typically it will therefore not be necessary to receive such data from the contra-lateral hearing aid.

The memory means can be configured in various ways as will occur to those skilled in the art. The memory means can include one or more types such as solid-state electronic memory, magnetic memory, and optical memory of the volatile and non-volatile variety. Furthermore, the memory means can be integral with one or more other components of a processing subsystem. As an example the individualized adjustment data and the various calibration data may be stored in distinct components.

Figure 3:
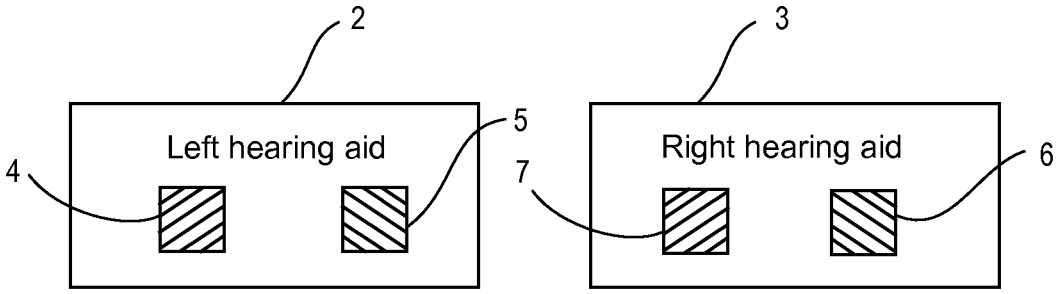
FIG. 3 Illustrates schematically the status of a binaural hearing aid system after the initialization process of FIG. 1 and FIG. 2, according to an embodiment of the present invention.

Reference is now made to FIG. 3. Here is illustrated schematically the status of a binaural hearing aid system after initialization according to an embodiment of the present invention. The left hearing aid 2 comprises left ipse-lateral data (i.e. a first set of individualized adjustment data, which are data about the specific compensation requirements of the left ear of the intended user and calibration data for the left hearing aid) stored in memory means 4 and left contra-lateral data (i.e. a second set of individualized adjustment data which are data about the specific compensation requirements of the right ear of the intended user and calibration data for the right hearing aid) stored in memory means 5. In a similar manner the right hearing aid 3 comprises right ipse-lateral data (i.e. the second set of individualized adjustment data as mentioned above and calibration data) stored in memory means 6 and right contra-lateral data (i.e. the first set of individualized adjustment data as mentioned above and calibration data) stored in memory means 7.

Figure 4:
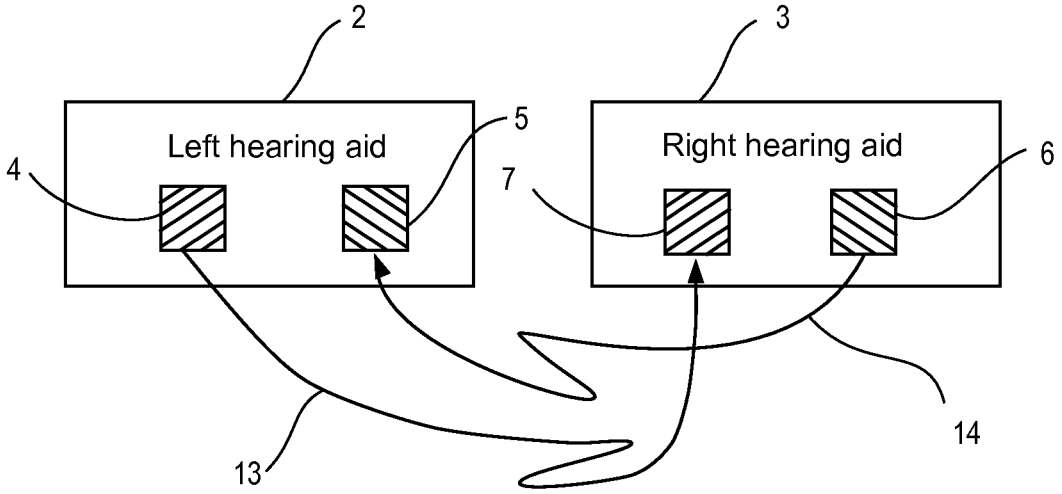
FIG. 4 Illustrates schematically a step in an initialization process of a binaural hearing aid system, according to an aspect of an embodiment of the present invention.

Reference is now made to FIG. 4, which illustrates how the first and second set of individualized adjustment data and possibly corresponding calibration data are exchanged wirelessly by data messages 13 and 14 between the two hearing aids at power up of the two hearing aids in order to ensure that updated sets of individualized adjustment data and calibration data are stored in both hearing aids. This is advantageous because both sets of data may change from day to day. E.g. adaptive microphone matching data is an example of calibration data that may change from day to day during normal operation, and the individualized adjustment data may change as a result of various types of fine tuning or hearing aid learning processes, either user initiated, automatic or a combination of both. Fine-tuning of the individualized adjustment data may also be the result of a follow up visit at the hearing aid dispenser. Limiting the exchange of individualized adjustment data to the initialization process at hearing aid power up provides a simple and power efficient method of synchronizing the two hearing aids in a binaural hearing aid system.

Figure 5:
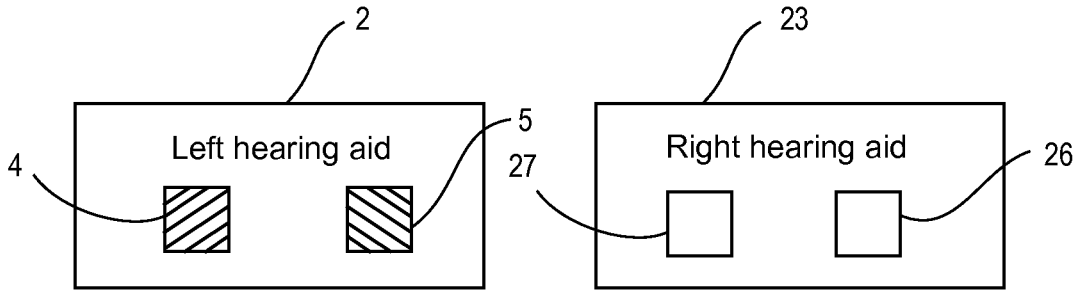
FIG. 5 Illustrates schematically the status of a binaural hearing aid system upon replacement of one hearing aid.

Reference is now made to FIG. 5, which illustrates schematically the status of a binaural hearing aid system after the right hearing aid has been replaced by a new right hearing aid 23. The new hearing aid 23 is received directly from the manufacturer. Consequently no individualized adjustment data have been programmed into the new right hearing aid 23. As opposed hereto the left hearing aid 2 comprises a full set of data as already described with reference to FIG. 3.

Figure 6:
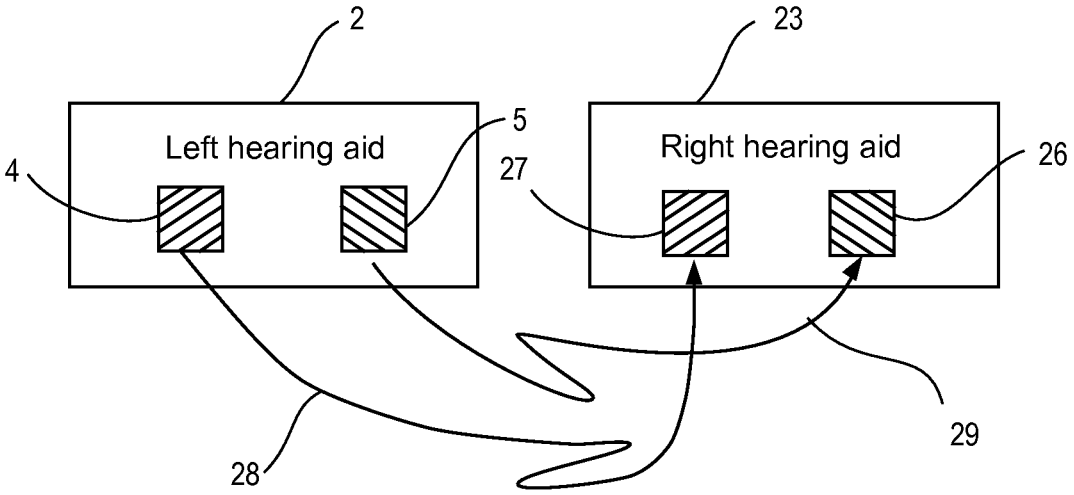
FIG. 6 Illustrates schematically a step in an initialization process of the binaural hearing aid system of FIG. 5, according to an aspect of an embodiment of the present invention.

Reference is now made to FIG. 6, which illustrates a procedure executed by the binaural hearing aid system upon power up of the two hearing aids of FIG. 5. As mentioned with reference to FIG. 5 the second set of individualized adjustment data is already stored in the left hearing aid 2 and are therefore simply transmitted to the right hearing aid 23 using a wireless data message 29 and subsequently stored in the memory means 26 in the right hearing aid. The memory means 26 then holds the second set of individualized adjustment data adapted to the specific compensation requirements of the right ear of the intended user. In a similar manner the first set of individualized adjustment data is transmitted to the right hearing aid 23 using a wireless data message 28 and subsequently stored in the memory means 27 in the right hearing aid. Hereby the data stored in the left hearing aid have been used as backup for the data required to make the new right hearing aid operational.

Figure 7:
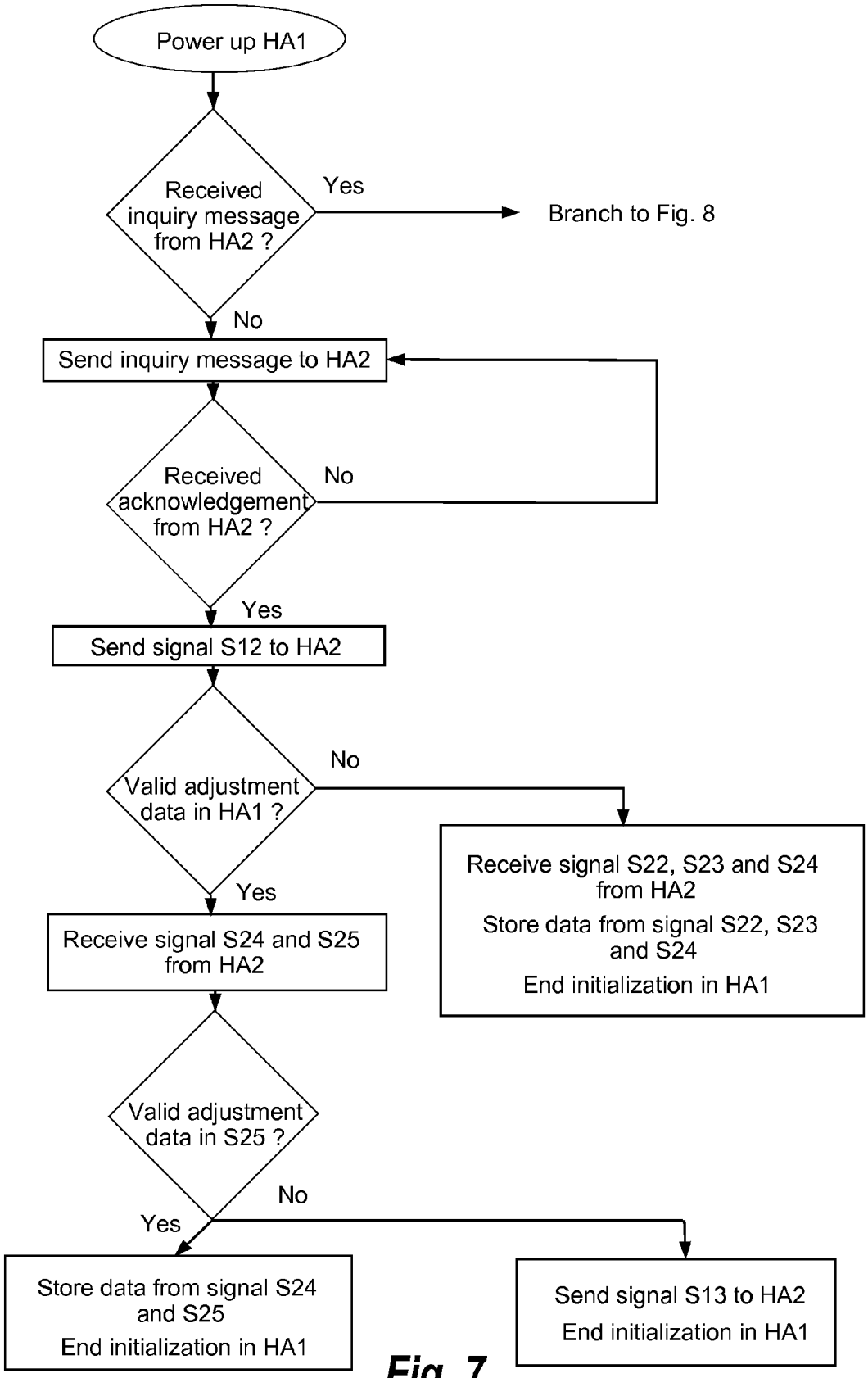
FIG. 7 is a flow diagram for illustrating an initialization procedure in a first hearing aid in a binaural hearing aid system according to the present invention.
Figure 8:
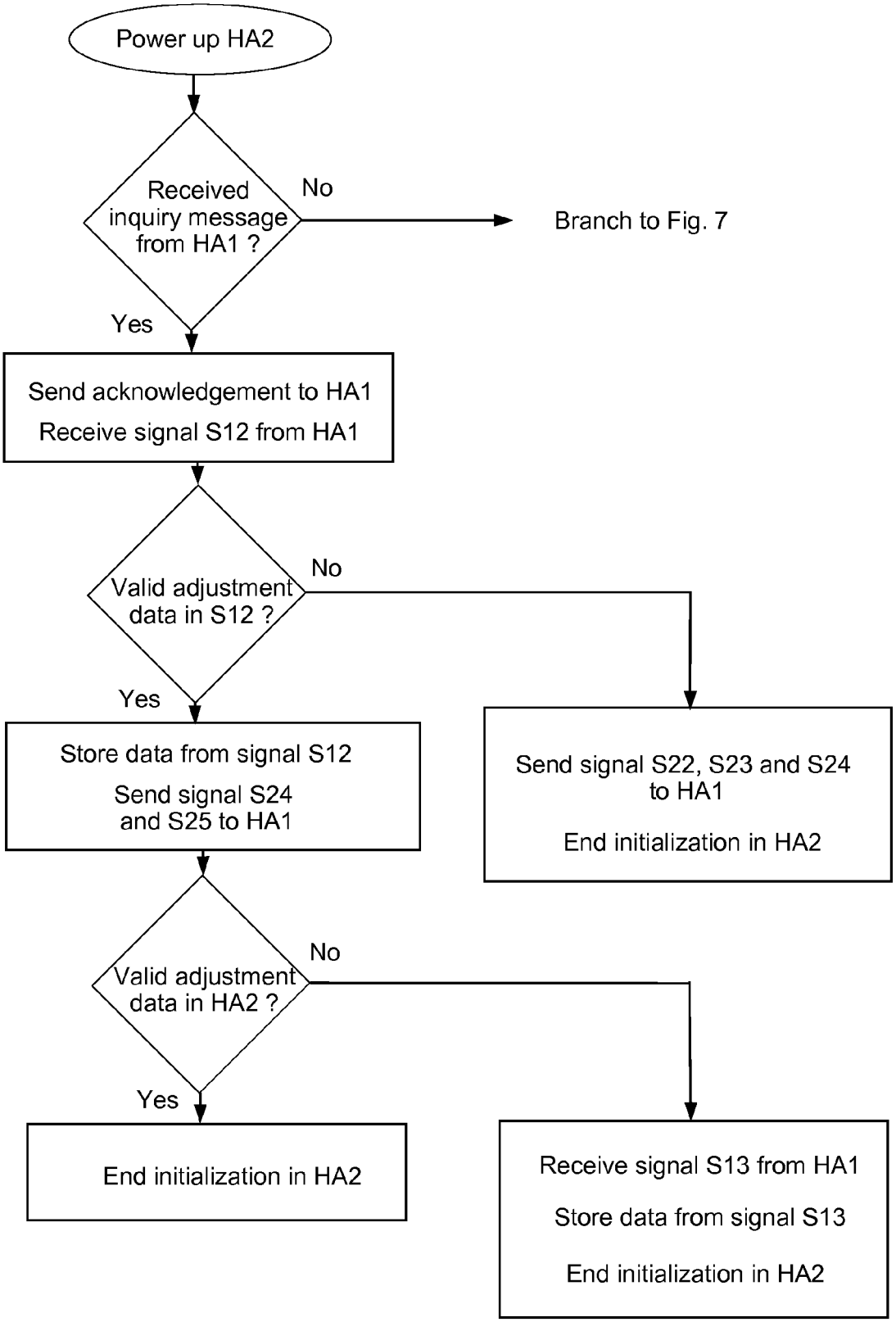
FIG. 8 is a flow diagram for illustrating an initialization procedure in a second hearing aid in a binaural hearing aid system at power up according to the present invention.

Further details concerning how to determine the direction of data transmission are given with reference to FIG. 7 and FIG. 8.

The transmitted wireless data message 28 includes calibration data, whereas this is not the case for the data message 29 because the manufacturer has programmed the ipse-lateral calibration data into the new hearing aid 23.

Reference is now made to FIG. 7 and FIG. 8 for an explanation of a general initialization process according to an embodiment of the present invention. Here the hearing aid that is first powered up is denoted the first hearing aid and the hearing aid that is powered up as the last in the binaural hearing aid system is denoted the second hearing aid.

Reference is now made to FIG. 7, which illustrates a flow diagram for initialization of a first hearing aid in a binaural hearing aid system at power up. Initially the first hearing aid is switched on and enters operation, while also listening whether an inquiry message is received from the other hearing aid. If the inquiry message is received, the first hearing aid branches to the steps described with reference to FIG. 8. If alternatively the first hearing aid does not receive such an inquiry message, the first hearing aid starts to transmit its own inquiry message, repeating with a predetermined time interval between each re-transmission of this second inquiry message. As long as the second hearing aid is not switched on nothing else happens. Once the second hearing aid is switched on, said second inquiry message is received by the second hearing aid, prompting the second hearing aid to respond by transmitting a first acknowledgement message back to the first hearing aid. When this first acknowledgement message is received by the first hearing aid, it triggers transmission of a first data message S12 from the first hearing aid and to the second hearing aid. The first data message comprises a first data block comprising data representing the result of an evaluation of whether the first hearing aid holds ipse-lateral adjustment data, a second data block comprising the ipse-lateral adjustment data for the first hearing aid if they exist in the first hearing aid and a third data block comprising ipse-lateral calibration data for the first hearing aid.

If it has been determined that the first hearing aid does not hold ipse-lateral adjustment data, the first hearing aid receives from the second hearing aid, in response to transmission of the first data message S12, a second data message S22 comprising ipse-lateral adjustment data for the first hearing aid, a third data message S23 comprising ipse-lateral adjustment data for the second hearing aid (i.e. contra-lateral adjustment data for the first hearing aid) and a fourth data message S24 comprising ipse-lateral calibration data for the second hearing aid. The data comprised in the second, third and fourth data messages are stored in the first hearing aid. Hereby the initialization process is finished in the first hearing aid and it will begin normal operation. In this way a binaural hearing aid system is initialized in the case where the first hearing aid initially did not hold ipse-lateral adjustment data. This case may e.g. arise upon a new first hearing aid having been received directly from the factory in replacement of a malfunctioning previous first hearing aid.

If alternatively it was determined, that the first hearing aid does hold ipse-lateral adjustment data, the first hearing aid receives, in response to transmission of the first data message S12 to the second hearing aid, the fourth data message S24 (as described above) and a fifth data message S25, which comprises a first data block comprising data representing the result of an evaluation of whether the second hearing aid holds ipse-lateral adjustment data and a second data block comprising these adjustment data, if they exist. The first hearing aid then determines, based on the contents of the first data block of the fifth data message S25, whether the second hearing aid does hold ipse-lateral adjustment data.

If the first hearing aid determines that the second hearing aid does not hold ipse-lateral adjustment data, then the first hearing aid transmits a sixth data message S13 which comprises ipse-lateral adjustment data for the second hearing aid (i.e. the contra-lateral adjustment data of the first hearing aid). Hereby the initialization process is finished in the first hearing aid and it will begin normal operation. In this way a binaural hearing aid system is initialized in the case where the second hearing aid initially does not contain ipse-lateral adjustment data. This case may e.g. arise upon a new second hearing aid having been received directly from the manufacturer in replacement of a previous second hearing aid.

If alternatively the first hearing aid determines that the second hearing aid does contain ipse-lateral adjustment data, then the ipse-lateral calibration data for the second hearing aid comprised in the fourth data message S24 and the ipse-lateral adjustment data for the second hearing aid comprised in second data block of the fifth data message S25 are stored in the first hearing aid. Hereby the initialization process is finished in the first hearing aid and it will begin normal operation. In this way a binaural hearing aid system is initialized, in the case where both of the hearing aids hold respective ipse-lateral adjustment data. This is a situation that will occur after initial fitting of the hearing aids as further described with reference to FIGS. 1-3. The situation may also occur at normal hearing aid power up as further described with reference to FIG. 4. In the first situation neither of the hearing aids comprise contra-lateral calibration and adjustment data. In the second situation both of the hearing aids comprise contra-lateral calibration and adjustment data.

Reference is now made to FIG. 8, which illustrates a flow diagram for initialization of a second hearing aid in a binaural hearing aid system at power up. It is noted that the information comprised in some of the signals has been described with reference to FIG. 7.

When the second hearing aid is switched on it evaluates whether an inquiry message S11 is received from the first hearing aid. If this is not the case the second hearing aid branches to the steps described with reference to FIG. 7. If alternatively the second hearing aid does receive such an inquiry message S11 the second hearing aid transmits an acknowledge message S21 back to the first hearing aid. When the acknowledge message S21 is received by the first hearing aid it triggers transmission of the first data message S12 from the first hearing aid and to the second hearing aid, as already described with reference to FIG. 7.

If the second hearing aid, based on the contents of the first data block of the first data message S12, determines that the first hearing aid does not contain ipse-lateral adjustment data, then the second hearing aid responds by transmitting the second, third and fourth data messages to the first hearing aid. Hereby the initialization process is finished in the second hearing aid and it will begin normal operation. In this way a binaural hearing aid system is initialized in the case where the first hearing aid initially does not contain ipse-lateral adjustment data. This case may e.g. arise upon a new first hearing aid having been received directly from the manufacturer in replacement of the previous first hearing aid.

If alternatively the second hearing determines that the first hearing aid does contain ipse-lateral adjustment data, then the second hearing aid will store the ipse-lateral adjustment data and calibration data for the first hearing aid. The second data block of the first data message S12 will comprise the adjustment data and the third data block will comprise the calibration data. Additionally the second hearing aid responds by transmitting the fourth data message S24 and fifth data message S25 to the first hearing aid.

Subsequently the second hearing aid evaluates whether it holds ipse-lateral adjustment data. If this is the case the initialization process is finished in the second hearing aid and it will begin normal operation. In this way a binaural hearing aid system is initialized, in the case where both of the hearing aids holds ipse-lateral adjustment data. This is a situation that will occur after initial fitting of the hearing aids as further described with reference to FIGS. 1-3. The situation may also occur at normal hearing aid power up as further described with reference to FIG. 4. In the first situation neither of the hearing aids comprise contra-lateral calibration and adjustment data. In the second situation both of the hearing aids comprise contra-lateral calibration and adjustment data.

Alternatively the second hearing aid determines that it does not contain ipse-lateral adjustment data. The second hearing aid then receives the sixth data message S13 from the first hearing aid and stores the contra-lateral adjustment data for the first hearing aid. Hereby the initialization process is finished in the second hearing aid and it will begin normal operation. In this way a binaural hearing aid system is initialized in the case where the second hearing aid initially does not contain ipse-lateral adjustment data. This case may e.g. arise upon a new second hearing aid having been received directly from the manufacturer in replacement of a previous second hearing aid. In this way the pair of hearing aids is self-configuring, if sufficient data are available, regardless of where the data can be found.

In another embodiment the hearing aids start normal operation temporarily as a part of the initialization process. Hereby the user is allowed some time for fine-tuning the hearing aids according to his or hers desires at a given moment in time before the data are exchanged, the initialization process finalized and normal operation resumed.

In yet another embodiment the initialization process may be triggered at any time during normal operation either by the user or automatically.

In another embodiment the first hearing aid will only transmit a limited number of inquiry messages to the second hearing aid. Following this the first hearing aid will determine that the second hearing aid is not operational and the first hearing aid will enter a set-up to monaural operation. Hereby the gain in the first hearing aid will be increased in order to account for the lack of the binaural loudness summation effect, which is the effect that the loudness of sound is increased when presented to both ears simultaneously. According to one embodiment the gain will be increased with a value in the range between 3 dB and 6 dB during monaural operation.

In another embodiment the binaural hearing aid system will enter a special set-up in response to identification of one or more failed hearing aid components. Failure of individual hearing aid components can in some cases be identified automatically by the hearing aid. Self test of hearing aid components is further described in e.g. WO-A1-2003007655.

In one embodiment the first hearing may detect that its microphones are not operational. Following this detection a data message, comprising data identifying the failure of the microphones, is transmitted to the second hearing aid. In response hereto the second hearing aid will set up transmission of at least one microphone signal to the first hearing aid and the first hearing aid will adapt its configuration in order to use the transmitted microphone signal as input. Hereby the first hearing aid can continue to be operational until the user receives a new hearing aid.

In another embodiment the first hearing aid may detect that the acoustic output transducer is not operational. Following this detection a data message, comprising data identifying the failure of the acoustic output transducer, is transmitted to the second hearing aid and subsequently the first hearing aid will set up transmission of at least one microphone signal to the second hearing aid. In response hereto the second hearing aid will adapt its configuration in order to use the transmitted microphone signal as input, when the signal quality of the transmitted microphone signal exceeds the internal microphone signal. In still another embodiment the second hearing aid will, in response to receiving said data message comprising data identifying the failure of the acoustic output transducer, adapt its configuration in order to sum the transmitted microphone signal and the internal microphone signal. In a further embodiment the second hearing aid is used to inform the hearing aid system user that the acoustical output transducer in the first hearing aid is no longer operational.

Reference is now made to FIG. 9, which illustrates the various states of the left and right hearing aids with respect to the individualized adjustment data, and the corresponding action to take for the initialization process. According to FIG. 9, each of the hearing aids can be in one of three general states: containing ipse- and contra-lateral adjustment data, just ipse-lateral adjustment data or no adjustment data. Thereby the pair of hearing aids can be in any one of nine states. These states and the respective actions are depicted in the table in FIG. 9. Dependent on the state of the two hearing aids in the binaural system, the hearing aids may exchange adjustment data to reach a state where both hearing aids hold updated versions of both sets of adjustment data. For reasons of clarity the exchange of the various types of calibration data is not included in FIG. 9.

The special case where none of the hearing aids contain any adjustment data requires programming of the hearing aids by a hearing aid dispenser according to well known principles. This situation should not occur while the hearing aids are at the users disposal, and if it occurs anyway the initialization will have to inhibit service.

Another case is one of the hearing aids containing only ipse-lateral adjustment data, while the other hearing aid does not contain any adjustment data. In principle this situation should not occur while the hearing aids are at the users disposal. Nevertheless, means may be included in the hearing aid system for detecting this situation and allowing the hearing aid with the ipse-lateral adjustment data to operate monaurally. During monaural operation the gain in the hearing aid will be increased in order to account for the lack of the binaural loudness summation effect. According to one embodiment the gain will be increased with a value in the range between 3 dB and 6 dB during monaural operation.

In case both hearing aids only contain ipse-lateral adjustment data, each hearing aid transmits a copy and subsequently receives and stores one copy of the contra-lateral adjustment data.

In case both hearing aids contain both ipse- and contra-lateral adjustment data, each hearing aid transmits a copy of the ipse-lateral adjustment data.

In case one of the hearing aids contains both ipse- and contra-lateral adjustment data and the other hearing aid only contains ipse-lateral adjustment data, each hearing aid transmits a copy of the ipse-lateral data.

In case one of the hearing aids contains both ipse- and contra-lateral adjustment data, while the other hearing aid does not contain any adjustment data, the first hearing aid will transmit both sets of adjustment data for storage in the other hearing aid.

Alternative initialization algorithms exist. The general principle is simply that if valid and updated adjustment and calibration data for both hearing aids are not available in one hearing aid then these data must be provided from the other hearing aid.

Other modifications and variations of the structures and procedures will be evident to those skilled in the art.

LIST OF SYMBOLS

S12: first data message comprising in a first data block, a representation of the result of a determination of whether the first hearing aid holds ipse-lateral adjustment data, in a second data block, the ipse-lateral adjustment data for the first hearing aid (if they exist) and in a third data block, ipse-lateral calibration data for the first hearing aid,

S13: sixth data message comprising the contra-lateral adjustment data for the first hearing aid,

S22: second data message comprising the contra-lateral adjustment data for the second hearing aid,

S23 third data message comprising the ipse-lateral adjustment data for the second hearing aid,

S24 fourth data message comprising the ipse-lateral calibration data for the second hearing aid,

S25 fifth data message comprising in a first data block, a representation of the result of a determination of whether the second hearing aid holds ipse-lateral adjustment data and in a second data block, the ipse-lateral adjustment data for the second hearing aid (if they exist).

We claim:

1. A method for hearing aid initialization in a binaural hearing aid system, said method comprising the steps of programming a first hearing aid with a first set of individualized adjustment data adapted to the specific compensation requirements of a first ear of the intended user, programming a second hearing aid with a second set of individualized adjustment data adapted to the specific compensation requirements of a second ear of the intended user, sending the first set of programmed individualized adjustment data from said first hearing aid, for storage in said second hearing aid, sending the second set of programmed individualized adjustment data from said second hearing aid, for storage in said first hearing aid, replacing said first hearing aid with a third hearing aid, determining if said third hearing aid comprises ipse-lateral adjustment data and in case it does not:

sending the first set of programmed individualized adjustment data from said second hearing aid for storage in said third hearing aid, and sending the second set of programmed individualized adjustment data from said second hearing aid for storage in said third hearing aid.

2. The method according to claim 1 wherein the step of programming said first hearing aid with the first set of individualized adjustment data is carried out by a hearing aid fitter, and the step of programming said second hearing aid with the second set of individualized adjustment data is carried out by a hearing aid fitter.

3. The method according to claim 1, comprising the steps of powering off said first and said second hearing aid, and powering on said first and said second hearing aid, thereby prompting the sending of the first set of programmed individualized adjustment data from said first hearing aid, and the sending of the second set of programmed individualized adjustment data from said second hearing aid.

4. The method according to claim 1, wherein the individualized adjustment data comprise filter coefficients for filters in a signal processing path of said first hearing aid.

5. The method according to claim 1, wherein calibration data are sent together with the individualized adjustment data.

6. The method according to claim 1, wherein data identifying failure of one or more hearing aid components are sent together with the individualized adjustment data.

7. The method according to claim 1 comprising the steps of sending ipse-lateral calibration data from said first hearing aid for storage in said third hearing aid, and receiving and storing said ipse-lateral calibration data in said third hearing aid.

8. The method according to claim 1, comprising determining in at least one of said first and said second hearing aid that the steps of the initialization process have been completed.

9. The method according to claim 1, comprising increasing the gain of said first hearing aid in order to account for the lack of the binaural loudness summation effect, while said second hearing aid is not operational.

10. The method according to claim 1, comprising configuration of at least one of said first and said second hearing aids in order to alleviate the failure of one or more hearing aid components.

11. A first hearing aid of a binaural hearing aid system comprising a transceiver configured to provide a bidirectional communication link with a second hearing aid of the binaural hearing aid system, a first memory configured to store ipse-lateral individualized adjustment data adapted to the specific compensation requirements of the intended user, a second memory configured to store contra-lateral individualized adjustment data adapted to the specific compensation requirements of the intended user, a detector which detects when a second hearing aid is powered up, a transmitter responsive to said detector which sends individualized adjustment data from said first hearing aid to said second hearing aid if said first hearing aid is storing individualized adjustment data when said second hearing aid is powered up, and a receiver responsive to said detector which receives individualized adjustment data from said second hearing aid.

12. The first hearing aid according to claim 11 characterized by comprising a third memory configured to store contra-lateral calibration data.

13. The first hearing aid according to claim 11 characterized by comprising a fourth memory configured to store ipse-lateral calibration data.

14. The first hearing aid according to claim 11, wherein said transmitter and receiver are responsive to said detector to send ipse-lateral and contra-lateral adjustment data to said second hearing aid if said second hearing aid does not store ipse-lateral adjustment data for the second hearing aid when powered up.

15. A binaural hearing aid system comprising a first hearing aid, said first hearing aid having a first transceiver;

a second hearing aid, said second hearing aid having a second transceiver;

said first and said second transceivers being configured to provide a bidirectional communication link between said first and said second hearing aid; wherein said first hearing aid has a first memory configured to store ipse-lateral individualized adjustment data adapted to the specific compensation requirements of a first ear of the intended user, a second memory means adapted for configured to store contra-lateral individualized adjustment data adapted to the specific compensation requirements of a second ear of the intended user, and a detector configured to detect when said second hearing aid is powered up; and wherein said first transceiver is configured to transmit individualized adjustment data to said second transceiver when said second hearing aid is powered up if individualized adjustment data are stored in said first hearing aid and configured to receive and store individualized adjustment data from said second hearing aid.

* * * * *